US010825401B2

(12) United States Patent
Chen

(10) Patent No.: US 10,825,401 B2
(45) Date of Patent: Nov. 3, 2020

(54) METHOD AND DEVICE FOR COMPENSATING VIEWING ANGLE CHROMATIC ABERRATION OF DISPLAY DEVICE, AND DISPLAY DEVICE

(71) Applicants: HKC CORPORATION LIMITED, Shuitan Village, Shiyan Sub (CN); CHONGQING HKC OPTOELECTRONICS TECHNOLOGY CO.,LTD., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/467,194

(22) PCT Filed: Sep. 1, 2017

(86) PCT No.: PCT/CN2017/100278
§ 371 (c)(1),
(2) Date: Jun. 6, 2019

(87) PCT Pub. No.: WO2018/120902
PCT Pub. Date: Jul. 5, 2018

(65) Prior Publication Data

US 2020/0074943 A1 Mar. 5, 2020

(30) Foreign Application Priority Data

Dec. 27, 2016 (CN) ..... 2016 1 1232570

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2320/0242* (2013.01); *G09G 2320/062* (2013.01)

(58) Field of Classification Search
CPC ..... G09G 3/3406; G09G 3/3611; G09G 3/36; G09G 2320/062; G09G 2320/0242; G09G 2340/16
See application file for complete search history.

(56) References Cited

U.S. PATENT DOCUMENTS

2008/0094426 A1* 4/2008 Kimpe ..... G09G 3/20 345/691

* cited by examiner

*Primary Examiner* — Liliana Cerullo
(74) *Attorney, Agent, or Firm* — Wang Law Firm, Inc.

(57) ABSTRACT

A method, device of compensating viewing angle chromatic aberration of a display device, and a display device are provided, wherein the method includes the steps as follows: receiving an inputted image, looking-up each of pixel driving signals of the inputted image and obtaining a first driving signal and a second driving signal corresponded to each of pixels within two adjacent frames of the image individually, computing a mean value of the first driving signals and a mean value of the second driving signals individually, computing a mean value of the first the second driving signals in the same frame of the image individually, computing a brightness compensation signal required in a backlight module of a backlight region based on the computed mean values and a predetermined standard brightness signal; and compensating viewing angle chromatic aberration of post frames of the image based on the brightness compensation signal.

12 Claims, 3 Drawing Sheets

METHOD AND DEVICE FOR COMPENSATING VIEWING ANGLE CHROMATIC ABERRATION OF DISPLAY DEVICE, AND DISPLAY DEVICE

CROSS-REFERENCE TO RELATED APPLICATION

This application is a National Stage Application of PCT International Patent Application No. PCT/CN2017/100278 filed on Sep. 1, 2017, under 35 U.S.C. § 371, which claims priority to Chinese Patent Application No. 201611232570.9 filed on Dec. 27, 2016, which are all hereby incorporated by reference in their entirety.

BACKGROUND OF THE INVENTION

1. Field of the Invention

The present application relates to the panel display technology, in particular, to a method and device for compensating viewing angle chromatic aberration of a display device, and a display device.

2. Description of the Related Art

Recently, most of large-size liquid crystal display panels utilize negative type VA liquid crystal or IPS liquid crystal technologies. The VA type liquid crystal technology has advantages of high production efficiency and low manufacturing cost in comparison with the IPS liquid crystal technology, but has obvious defects of optical properties in comparison with the IPS liquid crystal technology. Especially, a large-size liquid crystal display panel requires a larger viewing angle of presenting in commercial applications. The VA type liquid crystal driver is often unable to meet the demand of the commercial applications in terms of viewing angle chromatic aberration, which affects the promotion of the VA type liquid crystal technology.

A general method that a VA type liquid crystal technology overcomes viewing angle chromatic aberration is to further divide each of the primary colors RGB (red, green and blue) into a main pixel and a sub pixel, and solve the defect of viewing angle chromatic aberration via that the main and sub pixels provide different driving voltages in spatial. This kind of design often requires further designing metal wirings or thin film transistor elements for driving the sub pixel, which may sacrifice light transmittable opening regions, affects the transmittance of the panel, and directly results in the increased cost of a backlight module.

SUMMARY OF THE INVENTION

The present application provides a method of compensating viewing angle chromatic aberration of a display device executed via a computer device, which is able to reduce viewing angle chromatic aberration, gain the transmittance of the panel and reduce the cost of the backlight module.

In order to achieve the above objects, the method of compensating viewing angle chromatic aberration of a display device provided by the present application comprises the steps as follows:

controlling a display device to receive an inputted image; to look-up each of pixel driving signals of the inputted image and to obtain a first driving signal and a second driving signal corresponded to each of pixels within two adjacent frames of the image, individually;

computing a mean value of the first driving signals and a mean value of the second driving signals individually; computing a mean value of the first driving signal and the second driving signal in the same frame of the image individually;

computing a brightness compensation signal required in a backlight module of a backlight region based on the computed mean values and a predetermined standard brightness signal; and compensating viewing angle chromatic aberration of a post frame of the image based on the brightness compensation signal.

In an embodiment, when a backlight source of white color is utilized in the backlight module, the step of "computing a mean value of the first driving signals and a mean value of the second driving signals individually; computing a mean value of the first driving signal and the second driving signal in the same frame of the image individually" comprises:

computing a mean value of the first driving signals and a mean value of the second driving signals of a first primary color, individually; and computing a mean value of the first driving signals and the second driving signals of the first primary color in the same frame of image, individually.

In an embodiment, the first primary color is green.

In an embodiment, the step of "computing a brightness compensation signal required in a backlight module of a backlight region based on the computed mean values and a predetermined standard brightness signal" comprises:

substituting related parameters into following formulas and computing the required brightness compensation signals:

$$An_LG*\text{AverageGTH}+An_LG*\text{AverageGTL}=An_LG_N_1*\text{AverageGTH1}_TL1+An_LG_N_2*\text{AverageGTH2}_TL2;$$

$$An_LG_N_1*\text{AverageGTH1}_TL1=An_LG_N_2*\text{AverageGTH2}_TL2;$$

wherein An_LG is the predetermined standard brightness signal;

wherein AverageGTH is a mean value of the first driving signals of a green primary color pixel;

wherein AverageGTL is a mean value of the second driving signals of the green primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

In an embodiment, when a backlight source of three primary colors is utilized in the backlight module, the step of "computing a mean value of the first driving signals and a mean value of the second driving signals individually; computing a mean value of the first driving signal and the second driving signal in the same frame of the image individually" comprises:

computing a mean value of the first driving signals and a mean value of the second driving signals individually, of a first primary color, a second primary color and a third primary color; and computing a mean value of the first driving signals and the second driving signals individually, of a first primary color, a second primary color and a third primary color in the same frame of the image.

In an embodiment, the step of "computing a brightness compensation signal required in a backlight module of a backlight region based on the computed mean values and a predetermined standard brightness signal" comprises:

substituting related parameters into following formulas and computing the required brightness compensation signals:

$$An_LR*\text{AverageRTH}+An_LR*\text{AverageRTL}=An_LR_N_1*\text{AverageRTH1}_TL1+An_LR_N_2*\text{AverageRTH2}_TL_2;$$

$$An_LG*\text{AverageGTH}+An_LG*\text{AverageGTL}=An_LG_N_1*\text{AverageGTH1}_TL1+An_LG_N_2*\text{AverageGTH2}_TL2;$$

$$An_LB*\text{AverageBTH}+An_LB*\text{AverageBTL}=An_LB_N_1*\text{AverageBTH1}_TL1+An_LB_N_2*\text{AverageBTH2}_TL2;$$

$$An_LR_N_1*\text{AverageRTH1}_TL1=An_LR_N_2*\text{AverageRTH2}_TL2;$$

$$An_LG_N_1*\text{AverageGTH1}_TL1=An_LG_N_2*\text{AverageGTH2}_TL2;$$

$$An_LB_N_1*\text{AverageBTH1}_TL1=An_LB_N_2*\text{AverageBTH2}_TL2;$$

wherein An_LR_N_1, An_LG_N_1 and An_LB_N_1 are the predetermined standard brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_ and An_LB_N_2 are the required brightness compensation signals of the three primary colors.

The present invention provides a viewing angle chromatic aberration compensation device of a display device, comprising:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal in the same frame of the image individually;

a second computation module for computing a brightness compensation signal required in a backlight module of a backlight region based on the computed mean values and a predetermined standard brightness signal; and a backlight compensation module for compensating viewing angle chromatic aberration of a post frame of the image based on the brightness compensation signal.

In an embodiment, when the backlight module utilizes a backlight source of white color, the first computation module computes a mean value of the first driving signals and a mean value of the second driving signals individually; computing a mean value of the first driving signal and the second driving signal in the same frame of the image individually.

In an embodiment, the first primary color is green.

In an embodiment, the second computation module substitutes related parameters into following formulas and computes the required brightness compensation signals:

$$An_LG*\text{AverageGTH}+An_LG*\text{AverageGTL}=An_LG_N_1*\text{AverageGTH1}_TL1+An_LGN_2*\text{AverageGTH2}_TL2;$$

$$An_LG_N_1*\text{AverageGTH1}_TL1=An_LG_N_2*\text{AverageGTH2}_TL2;$$

wherein An_LG is the predetermined standard brightness signal;

wherein AverageGTH is a mean value of the first driving signals of a green primary color pixel;

wherein AverageGTL is a mean value of the second driving signals of the green primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

In an embodiment, when a backlight source of three primary colors is utilized in the backlight module, the first computation module computes the mean value of the first driving signals and a mean value of the second driving signals individually, of a first primary color, a second primary color and a third primary color; and computes the mean value of the first driving signal and the second driving signal in the same frame of the image individually, of a first primary color, a second primary color and a third primary color within the same frame of the image.

In an embodiment, the second computation modules substitutes related parameters into following formulas and computes the required brightness compensation signals:

$$An_LR*\text{AverageRTH}+An_LR*\text{AverageRTL}=An_LR_N_1*\text{AverageRTH1}_TL1+An_LR_N_2*\text{AverageRTH2}_TL2;$$

$$An_LG*\text{AverageGTH}+An_LG*\text{AverageGTL}=An_LG_N_1*\text{AverageGTH1}_TL1+An_LG_N_2*\text{AverageGTH2}_TL2;$$

$$An_LB*\text{AverageBTH}+An_LB*\text{AverageBTL}=An_LB_N_1*\text{AverageBTH1}_TL1+An_LB_N_2*\text{AverageBTH2}_TL2;$$

$$An_LR_N_1*\text{AverageRTH1}_TL1=An_LR_N_2*\text{AverageRTH2}_TL2;$$

$$An_LG_N_1*\text{AverageGTH1}_TL1=An_LG_N_2*\text{AverageGTH2}_TL2;$$

$$An_LB_N_1*\text{AverageBTH1}_TL1=An_LB_N_2*\text{AverageBTH2}_TL2;$$

wherein An_LR_N_1 、An_LG_N_1及 An_LB_N_1 are the predetermined brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_ and An_LB_N_2 are the required brightness compensation signals of the three primary colors.

The present application provides a display device, comprising:

a display device;

a driving component; and the viewing angle chromatic aberration compensation device of the display device as mentioned above.

In an embodiment, the viewing angle chromatic aberration compensation device of the display device comprises:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal in the same frame of the image individually;

a second computation module for computing a brightness compensation signal required in a backlight module of a backlight region based on the computed mean values and a predetermined standard brightness signal; and a backlight compensation module for compensating viewing angle chromatic aberration of a post frame of the image based on the brightness compensation signal.

In an embodiment, when a backlight source of white color is utilized in the backlight module, the first computation module computes a mean value of the first driving signals and a mean value of the second driving signals individually; computing a mean value of the first driving signal and the second driving signal in the same frame of the image individually.

In an embodiment, the first primary color is green.

In an embodiment, the second computation module substitutes related parameters into following formulas and computes the required brightness compensation signals:

$$An_LG*\text{AverageGTH}+An_LG*\text{AverageGTL}=An_LG_N_1*\text{AverageGTH1}_TL1+An_LGN_2*\text{AverageGTH2}_2;$$

$$An_LG_N_1*\text{AverageGTH1}_TL1=An_LG_N_2*\text{AverageGTH2}_TL2;$$

wherein An_LG is the predetermined standard brightness signal;

wherein AverageGTH is a mean value of the first driving signals of a green primary color pixel;

wherein AverageGTL is a mean value of the second driving signals of the green primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

In an embodiment, when a backlight source of three primary colors is utilized in the backlight module, the first computation module computes the mean value of the first driving signals and a mean value of the second driving signals individually, of a first primary color, a second primary color and a third primary color; and computes the mean value of the first driving signal and the second driving signal in the same frame of the image individually, of a first primary color, a second primary color and a third primary color within the same frame of the image.

In an embodiment, the second computation modules substitutes related parameters into following formulas and computes the required brightness compensation signals:

$$An_LR*\text{AverageRTH}+An_LR*\text{AverageRTL}=An_LR_N_1*\text{AverageRTH1}_TL1+An_LR_N_2*\text{AverageRTH2}_TL2;$$

$$An_LG*\text{AverageGTH}+An_LG*\text{AverageGTL}=An_LG_N_1*\text{AverageGTH1}_TL1+An_LG_N_2*\text{AverageGTH2}_TL2;$$

$$An_LB*\text{AverageBTH}+An_LB*\text{AverageBTL}=An_LB_N_1*\text{AverageBTH1}_TL1+An_LB_N_2*\text{AverageBTH2}_TL2;$$

$$An_LR_N_1*\text{AverageRTH1}_TL1=An_LR_N_2*\text{AverageRTH2}_TL2;$$

$$An_LG_N_1*\text{AverageGTH1}_TL1=An_LG_N_2*\text{AverageGTH2}_TL2;$$

$$An_LB_N_1*\text{AverageBTH1}_TL1=An_LB_N_2*\text{AverageBTH2}_TL2;$$

wherein An_LR_N_1、An_LG_N_1 及 An_LB_N_1 are the predetermined brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_ and An_LB_N_2 are the required brightness compensation signals of the three primary colors.

The technical solutions of the present application receives an inputted image in order to look-up each of pixel driving signals of the inputted image and obtains a first driving signal and a second driving signal corresponded to each of pixels within two adjacent frames of the image individually; maintains the front view brightness of each of the groups of the first driving signals and the second driving signals being the same as the front view brightness of the corresponded panel driving signals of each of pixels of the inputted image; computes a mean value of the first driving signals and a mean value of the second driving signals individually; computes a mean value of the first driving signals and the second driving signals in one frame of the image; computes a mean value of the first driving signals and the second driving signals in another frame of the image; computes and obtains the brightness compensation signals through these computed mean values and predetermined standard brightness signals, and inputs the brightness compensation signals to the corresponded regions of the backlight module, so as to achieve the compensation of viewing angle chromatic aberration.

The technical solutions of the present application does not need to dispose main and sub pixels on the panel, so that the metal wirings and the thin film transistor elements are not need to be designed for driving the sub pixel, which simplifies the manufacture process and reduce the cost thereof. Since the sub pixels are deleted, the transmittance of the panel is also be increased.

BRIEF DESCRIPTION OF THE DRAWINGS

The accompanying drawings required for describing embodiments or prior arts will be briefly described herein, for explaining the technical solutions of the embodiments of the present application or prior art more clearly. Apparently, the accompanying drawings in the following description are merely some embodiments of the present application. A person having ordinary skill in the art is able to obtain other drawings according to these appending drawings without under the premise of paying creative labor. In the accompanying drawings.

Figure 1:
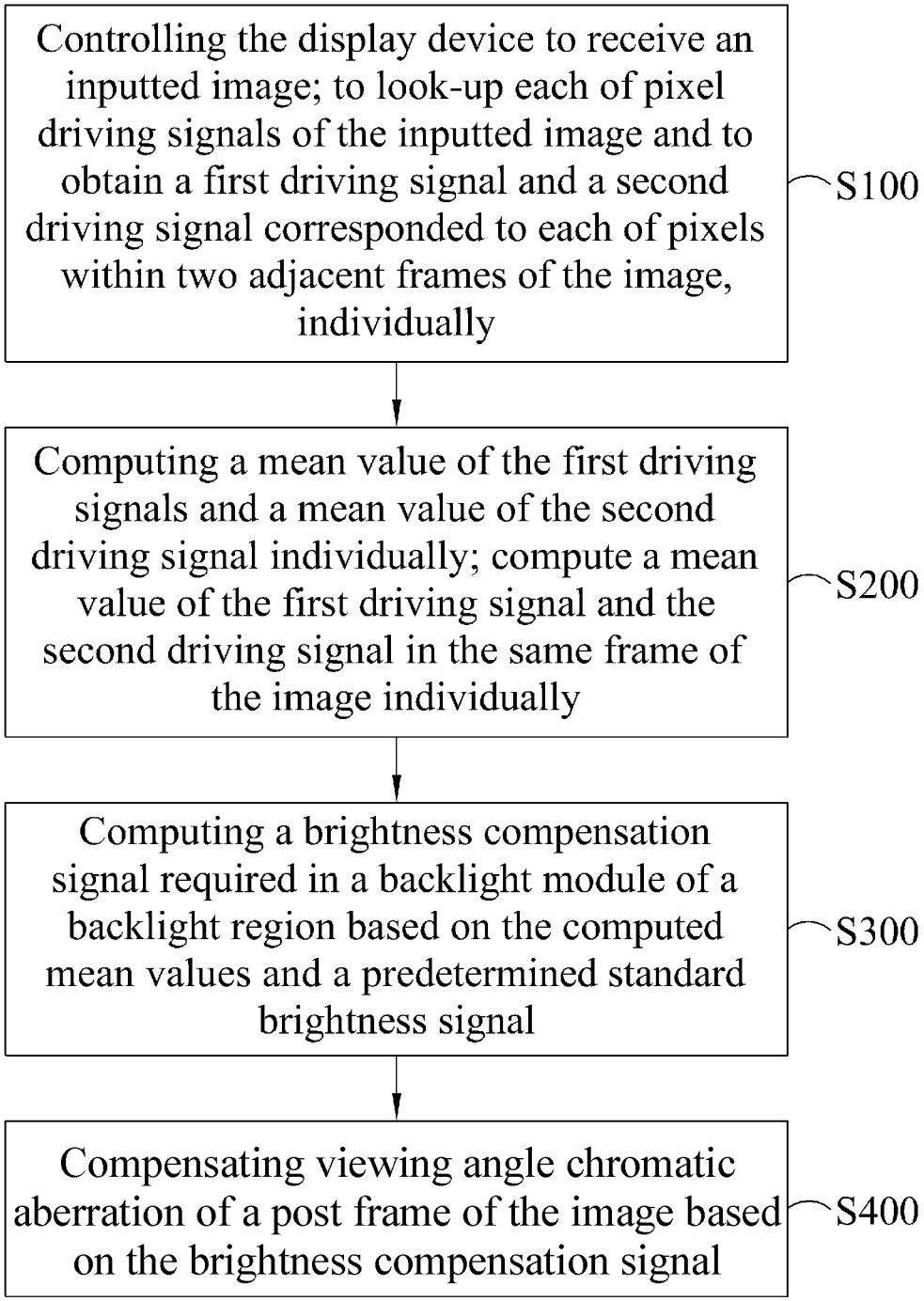
FIG. 1 is a flowing chart of an embodiment of the method of compensating viewing angle chromatic aberration of a display device of the present application.

The implementation, features and advantages of the objectives of the present application will be further described, taken in conjunction with embodiments and the accompanying drawings

DESCRIPTION OF THE PREFERRED EMBODIMENTS

Hereinafter, the present application will be described clearly and completely taken in conjunction with the accompanying drawings. Apparently, the described embodiments are merely a part, but not all, of the embodiments of the present application. Based on the embodiments of the present application, other embodiments obtained by a person skilled in the art without paying creative labor are in the scopes of the claims of the present application.

It has to be explained that all of the directional instructions (such as up, down, left, right, front, back . . . ) in the embodiments of the present application are merely used for explaining a relative position relationship, a motion and the likes, of each of the components in a specific configuration (as shown in the drawings). If the specific configuration is changed, the directional instructions may change correspondingly.

In addition, the terms of "the first", "the second" and the likes are merely used for description, but not to be understand as an indicating or implying the relative importance therebetween, or as implying the number of the technical feature being indicated. Hence, the features limited to "the first" and "the second" may indicate or imply that it comprises at least one of the features. Furthermore, the technical solutions between various embodiments may be combined with each other, but must be based on the fact that one of ordinary skill in the art can achieve the combination. When a combination of technical solutions is contradictory or impossible to be achieved, it should be considered as does not exist and is not protected by the scopes of the claim of the present application.

The present application provides a method of compensating viewing angle chromatic aberration of a display device.

Referring to FIG. 1, in an embodiment of the present application, the method of compensating viewing angle chromatic aberration of a display device comprises the steps as follows:

S100, receiving an inputted image; and looking-up each of pixel driving signals of the inputted image and obtaining a first driving signal and a second driving signal corresponded to each of pixels within two adjacent frames of the image, individually. It has to be explained that the front view brightness of each group of first driving signals and second driving signal are the same as the front view brightness of the corresponded panel driving signals of each of pixels of the inputted image, that is, the brightness achieved by utilizing the panel driving signal driver alone and utilizing two kinds of panel driving signal (high panel driving signal and low panel driving signal) are the same;

S200, computing a mean value of the first driving signals and a mean value of the second driving signals individually; computing a mean value of the first driving signal and the second driving signal in the same frame of the image individually. It has to be explained that dividing an original image signal into a frame of a first driving signal and another frame of a second driving signal is a relatively traditional compensation method which achieves the compensation of viewing angle chromatic aberration in a general sequence of timing. However, that whole of a frame are the first driving signals and whole of another frame are low voltage panels may be easy existed, so that the driven brightness of the both are not equivalent and resulted in blinking seen by human eyes. Hence, it is modified into that interweaved high and low voltage pixels are presented in the same frame, and that the first driving signals and the second driving signals of the same pixel are exchanged in a post frame of image. Thus, a mean value of the first driving signal and the second driving signal in the same frame, of the two frames of the image, are computed individually;

S300, computing a brightness compensation signal required in a backlight module of a backlight region based on the computed mean values and a predetermined standard brightness signal;

S400, compensating viewing angle chromatic aberration of a post frame of the image based on the brightness compensation signal. The present application divides the backlight into several regions, of which each of the regions comprises several high and low voltage pixels. The backlight brightness of each of the regions can be controlled individually, and the backlight brightness of each of the regions of each of the frames may be compensated based on the first driving signals and the second driving signals comprised in the same frame of the image within the region.

In the present embodiment, the first driving signal is a high level panel driving signal, and the second driving signal is a second driving signal.

It has to be explained that an image will be divided into two frames and be displayed, in the present embodiment. The two frames of the image are denoted as two adjacent frames of the image. In the signals of the two frames of the image in the present application, each frame of the image exist a high voltage signal and a low voltage signal simultaneously. The same pixel driving signal of a liquid crystal display panel is driven by the high voltage signal and the low voltage signal by turns corresponding to the frames of the image. The first driving signals $R_H/H_G/B_H$ and the second driving signals $R_L/G_L/B_L$ are preset high voltage signals and low voltage signals given based on RGB inputted signals beforehand, which are determined based on the effect of the viewing angle required for compensation. The related data is already burned into the display device during manufacture. Generally, it is recorded as a LUT (Look Up Table) in a hardware buffer. With the 8 bit driving signal, each of R/G/B input signals inputs 0~255 are corresponded to 256 high and low voltage signals. A total of 3*256 pairs of high voltage signals $R_H/H_G/B_H$ and low voltage signals $R_L/G_L/B_L$ are existed.

In a display device, the display performance is decided by commonly driving of the panel driving signal and the brightness signal of the backlight source.

In the present embodiment, computing a brightness compensation signal required in a backlight module of a backlight region based on the computed mean values and a predetermined standard brightness signal results in that the display device represents a display performance identical to that driven by the brightness compensation signal, the first driving signal and the second driving signal jointly, under a premise of the cooperation between the standard brightness signal, the first driving signal and the second driving signal.

The present application receives an inputted image in order to look-up each of pixel driving signals of the inputted image and obtains a first driving signal and a second driving signal corresponded to each of pixels within two adjacent frames of the image individually; maintains the front view brightness of each of the groups of the first driving signals and the second driving signals being the same as the front view brightness of the corresponded panel driving signals of each of pixels of the inputted image; computes a mean value of the first driving signals and a mean value of the second driving signals individually; computes a mean value of the first driving signals and the second driving signals in one frame of the image; and computes a mean value of the first driving signals and the second driving signals in another frame of the image; computes and obtains the brightness compensation signals through these computed mean values and predetermined standard brightness signals; and inputs the brightness compensation signals to the corresponded regions of the backlight module, so as to achieve the compensation of viewing angle chromatic aberration. The technical solutions of the present application does not need to dispose main and sub pixels on the panel, so that the metal wirings and the thin film transistor elements are not need to be designed for driving the sub pixel, which simplifies the manufacture process and reduce the cost thereof. Since the sub pixels are deleted, the transmittance of the panel is also be increased.

The present application comprises the embodiments as follows, corresponding to the types of backlight source utilized in the backlight module.

In an embodiment, when a backlight source of white color is utilized in the backlight module, the step of "computing a mean value of the first driving signals and a mean value of the second driving signals individually; computing a mean value of the first driving signal and the second driving signal in the same frame of the image individually" comprises: computing a mean value of the first driving signals and a mean value of the second driving signals of a first primary color, individually; and computing a mean value of the first driving signals and the second driving signals of the first primary color in the same frame of image, individually.

In the present embodiment, the first primary color is green. Since the white light source only needs to be controlled by a type of brightness signal; the brightness of green color is more obvious than that of red/blue; and the human eyes are more sensitive to the blinking level of those. Thus, the green color is utilized to compute the brightness compensation signal corresponding to the high pixel voltage and the low pixel voltage of the color panel driving signal.

In particular, the step of "computing a brightness compensation signal required in a backlight module of a backlight region based on the computed mean values and a predetermined standard brightness signal" comprises: substituting related parameters into following formulas and computing the required brightness compensation signals:

$$An_LG*\text{AverageGTH}+An_LG*\text{AverageGTL}=An_LG_N_1*\text{AverageGTH1}_TL1+An_LG_N_2*\text{AverageGTH2}_TL2\ \ldots \quad (1\text{-}1);$$

$$An_LG_N_1*\text{AverageGTH1}_TL1=An_LG_N_2*\text{AverageGTH2}_TL2\ \ldots \quad (2\text{-}1).$$

It has to be explained that the display panel of the display device receives the panel high and low voltage signals and displays the original image signals as Frame 1, Frame 2 in order individually. FrameN_1 corresponds to the panel driver corresponding to the first driving signals An_G1_TH/An_G2_TL/An_G3_TH . . . , An_Gm_TH; Frame N_2 corresponds to the panel low voltage driving signals An_G1_TL/An_G2_TH/An_G3_TL . . . , An_Gm_TL; Frame N_1 corresponds to the brightness signals A1_LL, A2_LL, A3_LL . . . , An_LL of the backlight of the region, wherein n=1, 2, 3, . . . N, n is the individually controllable light source region defined in the direct-type backlight; FrameN_2 corresponds to each of the brightness signals A1_LH, A2_LH, A3_LH . . . An_LH of the backlight of the region, wherein n=1, 2, 3, . . . , N, n is the individually controllable light source region defined in the direct-type backlight.

Wherein, An_LG is the predetermined standard brightness signal.

AverageGTH is a mean value of the first driving signals of a green primary color pixel, it is easy to understand that the AverageGTH here is the mean value of all of the first driving signals An_G1_TH, An_G2_TH, An_G3_TH, . . . An_Gm_TH of the two adjacent frames of the image.

AverageGTL is a mean value of the second driving signals, the average GTL here is the mean value of all of the second driving signals An_G1_TL, An_G2_TL, An_G3_TL, . . . An_Gm_TL of the two adjacent frames of the image.

AverageGTH1_TL1 is the mean value of the first driving signals and the second driving signals of the green color one frame of the image, the AverageGTH1_TL1 here is the mean value of the first driving signals and the second driving signals which are interweaved in order, of An_G1_TH, An_G2_TL, An_G3_TH, . . . An_G_TH; AverageGTH2_TL2 is the mean value of the first driving signals and the second driving signals of the green color of another frame of the image which are interweaved in order, of An_G1_TH, An_G2_TL, An_G3_TH, . . . An_G_TH.

An_LG_N_1 and An_LG_N_2 are the brightness compensation signals required for computation. An_LG_N_1 and An_LG_N_2 can be computed and obtained based on the Formulas 1-1 and 2-1.

In another embodiment, the backlight module is a backlight source of three primary colors, the step of "computing a mean value of the first driving signals and a mean value of the second driving signals individually; computing a mean value of the first driving signal and the second driving signal in the same frame of the image individually" comprises: computing a mean value of the first driving signals and a mean value of the second driving signals individually, of a first primary color, a second primary color and a third primary color; and computing a mean value of the first driving signals and the second driving signals individually, of a first primary color, a second primary color and a third primary color in the same frame of the image.

In an embodiment, the step of "computing a brightness compensation signal required in a backlight module of a backlight region based on the computed mean values and a predetermined standard brightness signal" comprises: substituting related parameters into following formulas and computing the required brightness compensation signals:

$$An_LR^{*}\text{AverageRTH}+An_LR^{*}\text{AverageRTL}=An_LR_N_1^{*}\text{AverageRTH1}_TL1+An_LR_N_2^{*}\text{AverageRTH2}_TL2\ldots \quad (1\text{-}2);$$

$$An_LG^{*}\text{AverageGTH}+An_LG^{*}\text{AverageGTL}=An_LG_N_1^{*}\text{AverageGTH1}_TL1+An_LG_N_2^{*}\text{AverageGTH2}_TL2\ldots \quad (2\text{-}2);$$

$$An_LB^{*}\text{AverageBTH}+An_LB^{*}\text{AverageBTL}=An_LB_N_1^{*}\text{AverageBTH1}_TL1+An_LB_N_2^{*}\text{AverageBTH2}_TL2\ldots \quad (3\text{-}2);$$

$$An_LR_N_1^{*}\text{AverageRTH1}_TL1=An_LR_N_2^{*}\text{AverageRTH2}_TL2\ldots \quad (1\text{-}3);$$

$$An_LG_N_1^{*}\text{AverageGTH1}_TL1=An_LG_N_2^{*}\text{AverageGTH2}_TL2\ldots \quad (2\text{-}3);$$

$$An_LB_N_1^{*}\text{AverageBTH1}_TL1=An_LB_N_2^{*}\text{AverageBTH2}_TL2\ldots \quad (3.3);$$

Wherein, An_LR_N_1, An_LG_N_1 and An_LB_N_1 are the predetermined standard brightness signals;

AverageRTH and AverageRTL are the mean value of the first driving signals and the mean value of the second driving signals of a red primary color, respectively. It is easy to understand that AverageRTH is the mean value of all of the first driving signals An_R1_TH, An_R2_TH, An_R3_TH, . . . An_Rm_TH of the two adjacent frames of the image of the red primary color pixel. AverageRTL is the mean value of all of the second driving signals An_R1_TL, An_R2_TL, An_R3_TL, . . . An_Rm_TL of the two adjacent frames of the image;

AverageGTH and AverageGTL are the mean value of the first driving signals and the mean value of the second driving signals of a green primary color, respectively. AverageGTH is the mean value of all of the first driving signals An_G1_TH, An_G2_TH, An_G3_TH, . . . An_Gm_TH of the two adjacent frames of the image of the green primary color pixel. AverageGTL is the mean value of all of the second driving signals An_G1_TL, An_G2_TL, An_G3_TL . . . An_Gm_TL of the two adjacent frames of the image;

AverageBTH and AverageBTL are the mean value of the first driving signals and the mean value of the second driving signals of a blue primary color, respectively. AverageGTH is the mean value of all of the first driving signals An_B1_TH, An_B2_TH, An_B3_TH, . . . An_Bm_TH of the two adjacent frames of the image of the green primary color pixel. AverageBTL is the mean value of all of the second driving signals An_B1_TL, An_B2_TL, An_B3_TL, . . . An_Bm_TL of the two adjacent frames of the image;

AverageRTH1_TL1 and AverageRTH2_TL2 are the mean value of the first driving signals and the second driving signals of the red primary color of two frames of the image, respectively. AverageRTH1_TL is the mean value of the first driving signals and the second driving signals which are interweaved in order, of An_R1_TH, An_R2_TL, An_R3_TH, . . . An_R_TH in a frame of the image of the red primary pixel. AverageRTH2_TL2 denotes the first driving signals and the second driving signals which are interweaved in order, of An_R1_TL、An_R2_TH、An_R3_TL、. . . An_R_TL in another frame of the image of the red primary pixel.

AverageGTH1_TL1 and AverageGTH2_TL2 are the mean value of the first driving signals and the second driving signals of the green primary color of two frames of the image, respectively. AverageGTH1_TL1 denotes the mean value of the first driving signals and the second driving signals which are interweaved in order, of An_G1_TH, An_G2_TL, An_G3_TH, . . . An_G_TH in a frame of the image of the green primary pixel. AverageGTH2_TL2 denotes the mean value of the first driving signals and the second driving signals which are interweaved in order, of An_G1_TL, An_G2_TH, An_G3_TL, . . . An_G_TL in another frame of the image of the green primary pixel.

AverageBTH1_TL1 and AverageBTH2_TL2 are the mean value of the first driving signals and the second driving signals of the blue primary color of two frames of the image, respectively. AverageBTH1_TL1 denotes the mean value of the first driving signals and the second driving signals which are interweaved in order, of An_B1_TH, An_B2_TL, An_B3_TH, . . . An_B_TH in a frame of the image of the blue primary pixel. AverageBTH2_TL2 denotes the mean value of the first driving signals and the second driving signals which are interweaved in order, of An_B1_TL, An_B2_TH, An_B3_TL, . . . An_B_TL in another frame of the image of the blue primary pixel.

An_LR_N_1, An_LR_N_2, An_LG_N_1, An_LG_N_2, An_LB_N_and An_LB_N_2 are the brightness compensation signals of RGB of three primary colors which are required for computation. Based on the Formulas 1-2, 1-3, 2-2, 2-3, 3-2 and 3-3, the brightness compensation signals An_LR_N_1, An_LR_N_2, An_LG_N_1, An_LG_N_2, An_LB_N_ and An_LB_N_2 may be computed and obtained.

It has to be explained that the mean values mentioned in the technical solutions of the present application are the mean values of the voltage values of the first driving signals and the second driving signals.

To solve the defect of viewing angle chromatic aberration of the TN, OCB and VA type TFT display panels, the technical solutions of the present application utilizes a direct or edge type backlight, white light or RGB (red, green, blue) light source of three colors, taken in conjunction with the panel high second driving signal, so as to compensate and to adjust the backlight brightness, and to reduce the blinking caused by the switching between the panel high and low voltage driving signals. Simultaneously, this may also maintain the advantage of the compensation of viewing angle chromatic aberration by the high and low liquid crystal voltage. Secondly, the pixel are not designed to be main and sub pixels, which greatly improves the transmittance of the TFT display panel and reduces the design of the backlight cost. In terms of the development of high resolution TFT display panels, the pixels without the main and sub pixel designs effects affects the transmittance and improvement of resolution more apparently.

Figure 2:
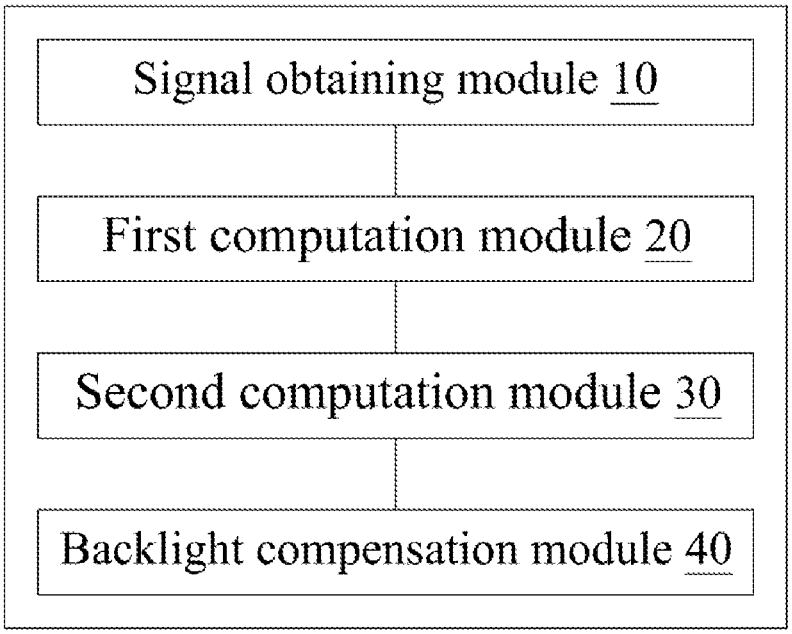
FIG. 2 is a functional block diagram of an embodiment of the method of compensating viewing angle chromatic aberration of a display device of the present application.

Referring to FIG. 2, based on the method of compensating viewing angle chromatic aberration of a display device mentioned above, the present application further provides a viewing angle chromatic aberration compensation device, comprising:

a signal obtaining module 10, for receiving an inputted image; and looking-up each of pixel panel driving signals of the inputted image and obtaining a first driving signal and a second driving signal corresponded to each of pixels within two adjacent frames of the image individually, which maintains the front view brightness of each of the groups of the first driving signals and the second driving signals being the same as the front view brightness of the corresponded panel driving signals of each of pixels of the inputted image;

a first computation module 20, for computing a mean value of the first driving signals and a mean value of the second driving signals individually; computing a mean value of the first driving signal and the second driving signal in the same frame of the image individually;

a second computation module 30, for computing a brightness compensation signal required in a backlight module of a backlight region based on the computed mean values and a predetermined standard brightness signal; and a backlight compensation module 40, for compensating viewing angle chromatic aberration of a post frame of the image based on the brightness compensation signal.

In an embodiment, when a backlight source of white color is utilized in the backlight module, the first computation module 20 computes a mean value of the first driving signals and a mean value of the second driving signals individually; computing a mean value of the first driving signal and the second driving signal in the same frame of the image individually.

In an embodiment, the first primary color is green.

In an embodiment, the second computation module 20 substitutes related parameters into following formulas and computes the required brightness compensation signals:

$$An_LG^{*}\text{AverageGTH}+An_LG^{*}\text{AverageGTL}=An_LGN_1^{*}\text{AverageGTH1}_TL1+An_LG_N_2^{*}\text{AverageGTH2}_TL2;$$

$$An_LG_N_1^{*}\text{AverageGTH1}_TL1=An_LG_N_2^{*}\text{AverageGTH2}_TL2;$$

wherein An_LG is the predetermined standard brightness signal;

wherein AverageGTH is a mean value of the first driving signals of a green primary color pixel;

wherein AverageGTL is a mean value of the second driving signals of the green primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

In an embodiment, when a backlight source of white color is utilized in the backlight module, the first computation module computes a mean value of the first driving signals and a mean value of the second driving signals individually; computing a mean value of the first driving signal and the second driving signal in the same frame of the image individually.

In an embodiment, the second computation module 30 substitutes related parameters into following formulas and computes the required brightness compensation signals:

$$An_LR^{*}\text{AverageRTH}+An_LR^{*}\text{AverageRTL}=An_LR_N_1^{*}\text{AverageRTH1}_TL1+An_LR_N_2^{*}\text{AverageRTH2}_TL2;$$

$$An_LG^{*}\text{AverageGTH}+An_LG^{*}\text{AverageGTL}=An_LG_N_1^{*}\text{AverageGTH1}_TL_1+An_LG_N_2^{*}\text{AverageGTH2}_TL2;$$

$$An_LB^{*}\text{AverageBTH}+An_LB^{*}\text{AverageBTL}=An_LB_N_1^{*}\text{AverageBTH1}_TL1+An_LB_N_2^{*}\text{AverageBTH2}_TL2;$$

$$An_LR_N_1^{*}\text{AverageRTH1}_TL1=An_LR_N_2^{*}\text{AverageRTH2}_TL2;$$

$$An_LG_N_1^{*}\text{AverageGTH1}_TL1=An_LG_N_2^{*}\text{AverageGTH2}_TL2;$$

$$An_LB_N_1^{*}\text{AverageBTH1}_TL1=An_LB_N_2^{*}\text{AverageBTH2}_TL2;$$

wherein An_LR_N_1 、An_LG_N_1 及 An_LB_N_1 are the predetermined brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_ and An_LB_N_2 are the required brightness compensation signals of the three primary colors.

A person skilled in the related art should understand that the present application further provides a viewing angle chromatic aberration compensation device of a display device, which comprises a processor and a nonvolatile memory. The nonvolatile memory stores executable instructions, and the processor executes the executable instructions in order to achieve the method described in each of aforementioned embodiments. A person skilled in the related art should further understand that the module/unit 10, 20, 30 and 40 shown in FIG. 14 of the present application may be a software module or a software unit. Furthermore, various software modules or software units may be stored in the nonvolatile memory and executed by the processor inherently.

Figure 3:
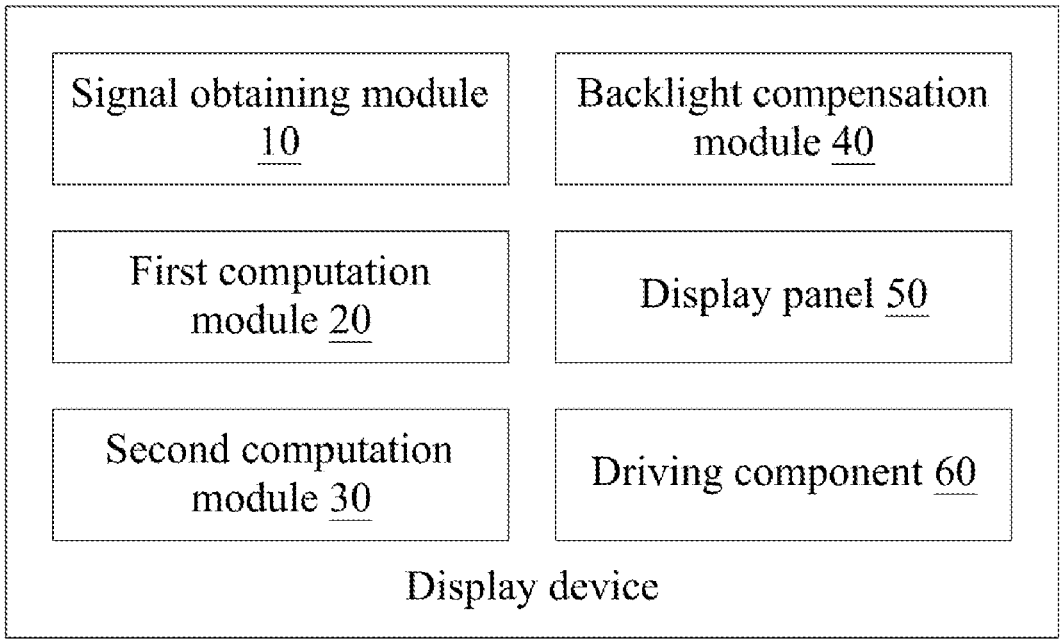
FIG. 3 is a functional block diagram of an embodiment of the display device of the present application.

Referring to FIG. 3, the present application further provide a display device, comprising a display panel 50, a driving component 60 and the viewing angle chromatic aberration compensation devices mentioned above. The substantial structure of the viewing angle chromatic aberration compensation devices of the display device are referred to the embodiments mentioned above. Since the present display device utilizes all of the technical solutions of the embodiments mentioned above, thus it possesses at least one of the benefits of the technical solutions of the embodiments mentioned above. Hence, they are no longer to be repeated one by one.

The display device may be utilized in the devices such as a television and a computer.

While the embodiments described above are merely preferable embodiments the present invention, hence the present invention is not limited thereto. In the context of the inventive concept of the present application, various equivalent changes of the structures, or directly/indirectly uses in other related technical fields are covered in the scope of the present invention.

What is claimed is:

1. A method of compensating a color washout problem of a display device, comprising steps as follows:

controlling the display device to receive an inputted image; to look-up each of pixel driving signals of the inputted image and to obtain a first driving signal and a second driving signal corresponded to each of pixels within two adjacent frames of the image, individually;

computing a mean value of the first driving signals and a mean value of the second driving signals individually; computing a mean value of the first driving signal and the second driving signal of the image individually;

computing a brightness compensation signal required in a backlight module of a backlight region based on the computed mean values and a predetermined standard brightness signal; and compensating the color washout problem of a post frame of the image based on the brightness compensation signal;

wherein the step of "computing a brightness compensation signal required in a backlight module of a backlight region based on the computed mean values and a predetermined standard brightness signal" comprises:

substituting related parameters into following formulas and computing the required brightness compensation signals:

$$An_LG \times \text{AverageGTH} + An_LG \times \text{AverageGTL} = An_LG_N_1 \times \text{AverageGTH1}_TL1 + An_LG_N_2 \times \text{AverageGTH2}_TL2;$$

$$An_LG_N_1 \times \text{AverageGTH1}_TL1 = An_LG_N_2 \times \text{AverageGTH2}_TL2;$$

wherein An_LG is the predetermined standard brightness signal;

wherein AverageGTH is a mean value of the first driving signals of a first primary color pixel;

wherein AverageGTL is a mean value of the second driving signals of the first primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

2. The method of compensating the color washout problem of a display device as claimed in claim 1, wherein when a backlight source of white color is configured in the backlight module, the step of "computing a mean value of the first driving signals and a mean value of the second driving signals individually; computing a mean value of the first driving signal and the second driving signal of the image individually" comprises:

computing a mean value of the first driving signals and a mean value of the second driving signals of the first primary color, individually; and computing a mean value of the first driving signal and the second driving signal of the first primary color of the image, individually.

3. The method of compensating the color washout problem of a display device as claimed in claim 2, wherein the first primary color is green.

4. A method of compensating a color washout problem of a display device, comprising steps as follows:

controlling the display device to receive an inputted image; to look-up each of pixel driving signals of the inputted image and to obtain a first driving signal and a second driving signal corresponded to each of pixels within two adjacent frames of the image, individually;

computing a mean value of the first driving signals and a mean value of the second driving signals individually; computing a mean value of the first driving signal and the second driving signal individually;

computing a brightness compensation signal required in a backlight module of a backlight region based on the computed mean values and a predetermined standard brightness signal; and compensating the color washout problem of a post frame of the image based on the brightness compensation signal;

wherein when a backlight source of three primary colors is configured in the backlight module, the step of "computing a mean value of the first driving signals and a mean value of the second driving signals individually; computing a mean value of the first driving signal and the second driving signal of the image individually" comprises:

computing mean values of the first driving signals and mean values of the second driving signals of a first primary color, a second primary color and a third primary color respectively; and computing mean values of the first driving signal and the second driving signal of a first primary color, a second primary color and a third primary color of the image respectively;

wherein the step of "computing a brightness compensation signal required in a backlight module of a backlight region based on the computed mean values and a predetermined standard brightness signal" comprises:

substituting related parameters into following formulas and computing the required brightness compensation signals:

$$An_LR \times AverageRTH + An_LR \times AverageRTL = An_LR_N_1 \times AverageRTH1_TL1 + An_LR_N_2 \times AverageRTH2_TL2;$$

$$An_LG \times AverageGTH + An_LG \times AverageGTL = An_LG_N_1 \times AverageGTH1_TL1 + An_LG_N_2 \times AverageGTH2_TL2;$$

$$An_LB \times AverageBTH + An_LB \times AverageBTL = An_LB_N_1 \times AverageBTH1_TL1 + An_LB_N_2 \times AverageBTH2_TL2;$$

$$An_LR_N_1 \times AverageRTH1_TL1 = An_LR_N_2 \times AverageRTH2_TL2;$$

$$An_LG_N_1 \times AverageGTH1_TL1 = An_LG_N_2 \times AverageGTH2_TL2;$$

$$An_LB_N_1 \times AverageBTH1_TL1 = An_LB_N_2 \times AverageBTH2_TL2;$$

wherein An_LR_N_1, An_LG_N_1 and An_LB_N_1 are the predetermined standard brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_1 and An_LB_N_2 are the required brightness compensation signals of the three primary colors.

5. A non-transitory color washout compensation device of a display device, comprising:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal of the image individually;

a second computation module for computing a brightness compensation signal required in a backlight module of a backlight region based on the computed mean values and a predetermined standard brightness signal; and a backlight compensation module for compensating a color washout problem of a post frame of the image based on the brightness compensation signal;

wherein the second computation module substitutes related parameters into following formulas and computes the required brightness compensation signals:

$$An_LG \times AverageGTH + An_LG \times AverageGTL = An_LG_N_1 \times AverageGTH1_TL1 + An_LG_N_2 \times AverageGTH2_TL2;$$

$$An_LG_N_1 \times AverageGTH1_TL1 = An_LG_N_2 \times AverageGTH2_TL2;$$

wherein An_LG is the predetermined standard brightness signal;

wherein AverageGTH is a mean value of the first driving signals of a first primary color pixel;

wherein AverageGTL is a mean value of the second driving signals of the first primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

6. The non-transitory color washout compensation device of the display device as claimed in claim 5, wherein when a backlight source of white color is configured in the backlight module, the first computation module computes a mean value of the first driving signals and a mean value of the second driving signals individually; computing a mean value of the first driving signal and the second driving signal of the image individually.

7. The non-transitory color washout compensation device of the display device as claimed in claim 5, wherein the first primary color is green.

8. A non-transitory color washout compensation device of a display device, comprising:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal individually;

a second computation module for computing a brightness compensation signal required in a backlight module of a backlight region based on the computed mean values and a predetermined standard brightness signal; and a backlight compensation module for compensating a color washout problem of a post frame of the image based on the brightness compensation signal;

wherein when a backlight source of three primary colors is configured in the backlight module, the first computation module computes the mean values of the first driving signals and mean values of the second driving signals of a first primary color, a second primary color and a third primary color respectively; and computes the mean values of the first driving signal and the second driving signal of a first primary color, a second primary color and a third primary color within the image respectively;

wherein the second computation modules substitutes related parameters into following formulas and computes the required brightness compensation signals:

$$An_LR \times AverageRTH + An_LR \times AverageRTL = An_LR_N_1 \times AverageRTH1_TL1 + An_LR_N_2 \times AverageRTH2_TL2;$$

$$An_LG \times AverageGTH + An_LG \times AverageGTL = An_LG_N_1 \times AverageGTH1_TL1 + An_LG_N_2 \times AverageGTH2_TL2;$$

$$An_LB \times AverageBTH + An_LB \times AverageBTL = An_LB_N_1 \times AverageBTH1_TL1 + An_LB_N_2 \times AverageBTH2_TL2;$$

$$An_LR_N_1 \times AverageRTH1_TL1 = An_LR_N_2 \times AverageRTH2_TL2;$$

$$An_LG_N_1 \times AverageGTH1_TL1 = An_LG_N_2 \times AverageGTH2_TL2;$$

$$An_LB_N_1 \times AverageBTH1_TL1 = An_LB_N_2 \times AverageBTH2_TL2;$$

wherein An_LR_N_1, An_LG_N_1 and An_LB_N_1 are the predetermined brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_1 and An_LB_N_2 are the required brightness compensation signals of the three primary colors.

9. A display device, comprising:

a display device;

a driving component; and a color washout compensation device, comprising:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal of the image individually;

a second computation module for computing a brightness compensation signal required in a backlight module of a backlight region based on the computed mean values and a predetermined standard brightness signal; and a backlight compensation module for compensating a color washout problem of a post frame of the image based on the brightness compensation signal;

wherein the second computation module substitutes related parameters into following formulas and computes the required brightness compensation signals:

$$An_LG \times AverageGTH + An_LG \times AverageGTL = An_LG_N_1 \times AverageGTH1_TL1 + An_LG_N_2 \times AverageGTH2_TL2;$$

$$An_LG_N_1 \times AverageGTH1_TL1 = An_LG_N_2 \times AverageGTH2_TL2;$$

wherein An_LG is the predetermined standard brightness signal;

wherein AverageGTH is a mean value of the first driving signals of a first primary color pixel;

wherein AverageGTL is a mean value of the second driving signals of the first primary color pixel;

wherein AverageGTH1_TL1 is a mean value of the first driving signals and the second driving signals of one frame of the image;

wherein AverageGTH2_TL2 is a mean value of the first driving signals and the second driving signals of another frame of the image; and wherein An_LG_N_1 and An_LG_N_2 are the brightness compensation signals requiring for computation.

10. The display device as claimed in claim 9, wherein when a backlight source of white color is configured in the backlight module, the first computation module computes a mean value of the first driving signals and a mean value of the second driving signals individually; computing a mean value of the first driving signal and the second driving signal of the image individually.

11. The display device as claimed in claim 9, wherein the first primary color is green.

12. A display device, comprising:

a display device;

a driving component; and a color washout compensation device, comprising:

a signal obtaining module for receiving an inputted image; and looking-up each of pixel panel driving signals of the inputted image and obtaining a first driving signal and a second driving signal corresponded to each of pixels within two adjacent frames of the image, individually;

a first computation module for computing a mean value of the first driving signals and a mean value of the second driving signals individually; computing a mean value of the first driving signal and the second driving signal individually;

a second computation module for computing a brightness compensation signal required in a backlight module of a backlight region based on the computed mean values and a predetermined standard brightness signal; and a backlight compensation module for compensating a color washout problem of a post frame of the image based on the brightness compensation signal;

wherein when a backlight source of three primary colors is configured in the backlight module, the first computation module computes the mean values of the first driving signals and mean values of the second driving signals of a first primary color, a second primary color and a third primary color respectively; and computes the mean values of the first driving signal and the second driving signal of a first primary color, a second primary color and a third primary color within the image respectively;

wherein the second computation modules substitutes related parameters into following formulas and computes the required brightness compensation signals:

$$An_LR \times \text{AverageRTH} + An_LR \times \text{AverageRTL} = An_LR_N_1 \times \text{AverageRTH1}_TL1 + An_LR_N_2 \times \text{AverageRTH2}_TL2;$$

$$An_LG \times \text{AverageGTH} + An_LG \times \text{AverageGTL} = An_LG_N_1 \times \text{AverageGTH1}_TL1 + An_LG_N_2 \times \text{AverageGTH2}_TL2;$$

$$An_LB \times \text{AverageBTH} + An_LB \times \text{AverageBTL} = An_LB_N_1 \times \text{AverageBTH1}_TL1 + An_LB_N_2 \times \text{AverageBTH2}_TL2;$$

$$An_LR_N_1 \times \text{AverageRTH1}_TL1 = An_LR_N_2 \times \text{AverageRTH2}_TL2;$$

$$An_LG_N_1 \times \text{AverageGTH1}_TL1 = An_LG_N_2 \times \text{Average}\ GTH2_TL2;$$

$$An_LB_N_1 \times \text{AverageBTH1}_TL1 = An_LB_N_2 \times \text{AverageBTH2}_TL2;$$

wherein An_LR_N_1, An_LG_N_1 and An_LB_N_1 are the predetermined brightness signals;

wherein AverageRTH and AverageRTL are the mean value of the first driving signals and the mean value of the second driving signals of a red primary color, respectively;

wherein AverageGTH and AverageGTL are the mean value of the first driving signals and the mean value of the second driving signals of a green primary color, respectively;

wherein AverageBTH and AverageBTL are the mean value of the first driving signals and the mean value of the second driving signals of a blue primary color, respectively;

wherein AverageRTH1_TL1 and AverageRTH2_TL2 are the mean value of the first driving signals and the second driving signals of the red primary color of two frames of the image, respectively;

wherein AverageGTH1_TL1 and AverageGTH2_TL2 are the mean value of the first driving signals and the second driving signals of the green primary color of two frames of the image, respectively;

wherein AverageBTH1_TL1 and AverageBTH2_TL2 are the mean value of the first driving signals and the second driving signals of the blue primary color of two frames of the image, respectively; and An_LR_N_1, An_LR_N_2, An_LG_N_1, An_LG_N_2, An_LB_N_1 and An_LB_N_2 are the required brightness compensation signals of the three primary colors.

* * * * *